US010410559B2

(12) United States Patent
Meng et al.

(10) Patent No.: US 10,410,559 B2
(45) Date of Patent: Sep. 10, 2019

(54) PERSISTENCE OF VISION ROTARY DISPLAY DEVICE

(71) Applicants: Weihui Ted Meng, Cary, NC (US); Quan Zhou, Cary, NC (US)

(72) Inventors: Weihui Ted Meng, Cary, NC (US); Quan Zhou, Cary, NC (US)

( * ) Notice: Subject to any disclaimer, the term of this patent is extended or adjusted under 35 U.S.C. 154(b) by 0 days.

(21) Appl. No.: 15/877,688

(22) Filed: Jan. 23, 2018

(65) Prior Publication Data

US 2019/0228690 A1 Jul. 25, 2019

(51) Int. Cl.
*G09G 3/00* (2006.01)

(52) U.S. Cl.
CPC ..... *G09G 3/005* (2013.01); *G09G 2370/16* (2013.01); *G09G 2380/06* (2013.01); *G09G 2380/10* (2013.01); *G09G 2380/12* (2013.01)

(58) Field of Classification Search
CPC ..... G09G 3/005; G09G 2380/06; G09G 2380/10; G09G 2380/12; G09G 2370/16
See application file for complete search history.

(56) References Cited

U.S. PATENT DOCUMENTS 6,433,761 B1 * 8/2002 Remitz ..... G09G 3/005 340/815.87
10,109,224 B1 * 10/2018 Ratti ..... G09G 3/005
2004/0102223 A1 * 5/2004 Lo ..... G09F 9/33 455/566
2006/0071622 A1 * 4/2006 Townsend ..... B25J 9/1612 318/400.31
2010/0118209 A1 * 5/2010 Hardacker ..... G08C 17/02 348/734
2018/0166006 A1 * 6/2018 Cauwood ..... G09F 27/005

* cited by examiner

*Primary Examiner* — Liliana Cerullo
(74) *Attorney, Agent, or Firm* — John L. Sotomayor

(57) ABSTRACT

The persistence of vision rotary display device is a display that presents 2-D and 3-D images that appear to float in midair through the timely energization of a plurality of LEDs that travel in circular paths on a rotor. The rotor is driven by a motor mounted in a stator; the stator may be mounted to a fixed structure or held in a user's hand. The device achieves a resolution that is not limited by the physical size of the LEDs by mounting LEDs on multiple arms with a different offset from the center on each arm. Control electronics in the rotor map the image to polar format and adjust the timing of the LEDs to compensate for the fact that they may be on different arms. The device may present moving images by changing the image at a predetermined frame rate.

8 Claims, 10 Drawing Sheets

Use case: Used inside store as a digital signage

Use case: LED display on Drone

Use case: Ceiling Fan

PERSISTENCE OF VISION ROTARY DISPLAY DEVICE

CLAIM TO PRIORITY

This Non-Provisional application claims under 35 U.S.C. § 120, the benefit of the Provisional Application 62/568,407, filed Oct. 5, 2017, Titled "Persistence of vision rotary display device" which is hereby incorporated by reference in its entirety.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

Display systems utilizing LEDs are well used to provide cost-effective and active displays for advertisement and informational purposes. Many systems exist to provide moving displays mounted on buildings, the sides of transport vehicles, or commercial vehicles to provide such LED displays to various groups of potential clients. LED displays are provided in static arrays and flat panel configurations to permit control programmatically on the information and/or advertising a client wishes to present on the LED display. Such displays are generally programmable but static in position.

The present invention relates to the field of display devices, more specifically, to a display device that utilizes persistence of vision and a plurality of LEDs mounted strategically to increase the resolution of the display.

BRIEF DESCRIPTION OF THE DRAWINGS

Certain illustrative embodiments illustrating organization and method of operation, together with objects and advantages may be best understood by reference to the detailed description that follows taken in conjunction with the accompanying drawings in which.

DETAILED DESCRIPTION

Figure 1:
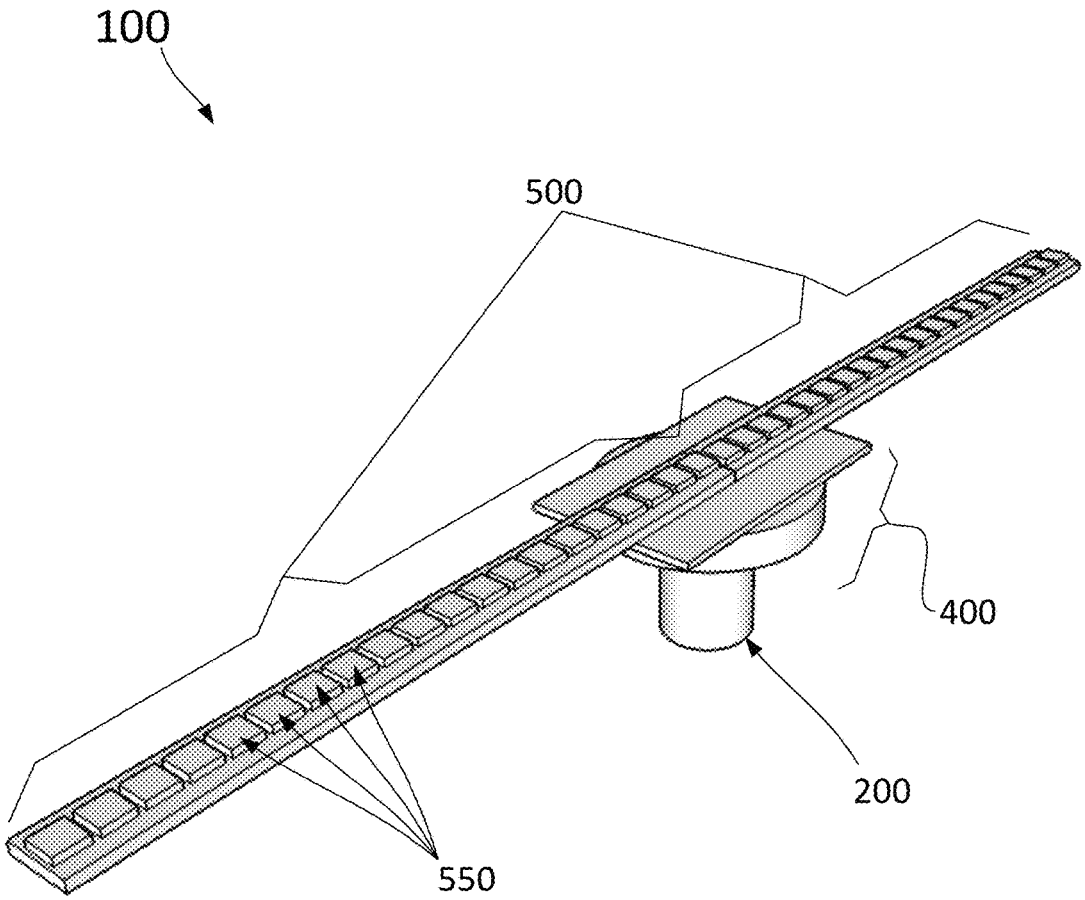
FIG. 1 is a perspective view consistent a two-arm rotary display consistent with certain embodiments of the present invention.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used herein, "2-D" or "2D" is an abbreviation for two-dimensional, meaning that an object has width and length but lacks height. Any point on a 2-D object can be designated using two co-ordinates which are measurements relative to two orthogonal reference axes.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may be construed to mean recharging or replacing individual cells, individual batteries of cells, or a package of multiple battery cells as is appropriate for any given battery technology that may be used.

As used in this disclosure, a "blade" is a term that is used to describe a wide and flat structure, or portion of a larger structure such as a propeller, or the cutting edge of a tool.

As used in this disclosure, the "center of rotation" is the point of a rotating plane that does not move with the rotation of the plane.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", mean connected, either directly or indirectly and does not necessarily imply a mechanical connection.

As used in this disclosure, a "display" is a surface upon which is presented an image, potentially including, but not limited to, graphic images and text, that is interpretable by an individual viewing the image. When used as a verb, "display" means to present such an image.

As used in this disclosure, the terms "distal" and "proximal" may be used to describe the relative location of two objects. Distal is intended to mean the object, or the end of an object, that is situated away from the point of origin, point of reference, or point of attachment. Proximal is intended to mean the object, or end of an object, that is situated towards the point of origin, point of reference, or point of attachment. Distal implies 'farther away from' and proximal implies 'closer to'. In some instances, the point of origin or point of reference may be a center point or a central axis of an object and the direction of comparison may be in a radial or lateral direction.

As used in this disclosure, an "electric motor" is a device that converts electric energy into rotational mechanical energy.

As used herein, the word "energization" refers to the act of energizing an electrical component or electrical subsystem.

As used in this disclosure, when referring to an item or device, "handheld" means that the size and weight of the item or device is appropriate for operation while a person holds the item or device with one or both hands.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, an "image" is an optical representation or reproduction of an indicia or of the appearance of something or someone.

As used in this disclosure, an "LED" is an acronym for a light emitting diode. An LED allows current to flow in one direction and when current is flowing the LED emits photons in a narrow spectral range. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used herein, the word "longitudinal" refers to a lengthwise direction.

As used herein, the word "pitch" refers to the center-to-center spacing between a plurality of objects or holes.

As used in this disclosure, the term "radial" refers to a direction that projects away from a center point.

As used in this disclosure, "vertical" refers to a direction that is parallel to the local force of gravity. Unless specifically noted in this disclosure, the vertical direction is always perpendicular to horizontal.

Hardware components of this high-speed rotating LED image display includes an LED bar, a motor, one end of the LED rod and a motor, and an FPGA unit. The picture processing unit includes a picture reading module, a round module and a coordinate corresponding module. The FPGA unit includes an SDRAM, an SDM, an SDM, an image processing unit, and an FPGA unit, SDRAM data read/write module, SD card data/write module, and LED display control module.

The stator may be an enclosure for the electric motor. In some embodiments, the invention may be battery powered and the stator may enclose one or more batteries. The invention may be operated in any orientation—the shaft of the electric motor may be vertical with the stator above or below the rotor. The shaft may be horizontal. In some embodiments the invention may be handheld and the invention may be moved and tilted while in use.

The stator may be mounted to a fixed structure. As non-limiting examples, the fixed structure may be a ceiling or a wall. In some embodiments, the invention may be portable and the stator may be held in a hand (not illustrated in the figures) of a user (not illustrated in the figures).

The electric motor may cause the shaft to rotate when the electric motor is energized. Rotation of the shaft may cause the rotor to spin.

The persistence of vision rotary display device (hereinafter invention) comprises a rotor, a stator, and two or more linear display arms. The rotor is rotationally coupled to the stator and moves a plurality of LEDs mounted onto the two or more linear display arms in circular paths. The invention presents a 2-dimensional image that appears to float in midair through the timely energization of each of the plurality of LEDs as the plurality of LEDs 550 complete the circular path. A linear display offset in the positioning of each individual linear display arm selected from the two or more linear display arms enhances the appearance and persistence of the display, permitting the user to experience a more active and robust presentation of information.

The rotor may be a rotating base for the invention. The rotor may be coupled to the two or more linear display arms and may be coupled to a shaft of an electric motor. The rotor may comprise control electronics. In some embodiments, the control electronics may be housed in an enlarged, central hub of the rotor.

The control electronics may control the illumination of the plurality of LEDs on the two or more linear display arms to present the 2-dimensional image. Specifically, the control electronics may determine when, during their rotation around a center of the rotor, each of the plurality of LEDs should be energized. The control electronics may remap pixels of a 2-dimensional image, or in an alternative, non-limiting example, from a 3-dimensional image, from a Cartesian coordinate system to polar coordinates and associated height, or z-axis, coordinates so that the control electronics can determine which of the plurality of LEDs that are following the circular paths should be illuminated and when. In some embodiments, the remapping of pixels from Cartesian to polar coordinates and associated height, or z-axis, coordinates may be repeated at a frame rate that results in multiple images being presented every second. This may give the impression of full-motion video being displayed on the invention in either 2-dimensional or 3-dimensional format.

The control electronics may be able to sense a specific display angle of the rotor 400 with respect to the stator so that the 2-dimensional image may be repeatably oriented with respect to a reference angle. As a non-limiting example, the control electronics may sense signals arriving from one or more optical interrupters (not illustrated in the figures) at least once per rotation of the rotor. The control electronics may be able to sense the rotational speed of the rotor with respect to the stator. As a non-limiting example, speed of rotation may be derived from the timing of signals arriving from the one or more optical interrupters that are used to determine the reference angle. Sensing the rotational speed may allow the control electronics to adjust the timing of energization of the plurality of LEDs so that the control electronics might compensate for slight variations in the rotational speed for the rotor. In some embodiments, the control electronics may be able to control the speed of rotation of the rotor.

The two or more linear display arms may be coupled to the rotor in a radial arrangement. For the individual linear display arm selected from the two or more linear display arms, a proximal end of the individual linear display arm may be located at or adjacent to the center of the rotor and a distal end of the individual linear display arm may be suspended in the air away from the center of the rotor. The center of the rotor and all of the plurality of LEDs on the individual linear display arm form a straight line as viewed from above. For the purposes of describing the invention, the longitudinal axis of the shaft of the electric motor shall define the vertical or up/down direction with the plurality of LEDs being at the top and the stator being at the bottom. In this orientation, the invention will present the 2-dimensional image on the top of the invention.

The plurality of LEDs may be capable of displaying more than one color when energized and therefore the 2-dimensional image presented by the invention may be in color.

The plurality of LEDs on the individual linear display arm may be spaced a consistent distance apart, as measured from the center of a first LED to the center of a second LED where the first LED is adjacent to the second LED. This distance from the center of the first LED to the center of the second LED is known as an LED pitch.

Figure 7:
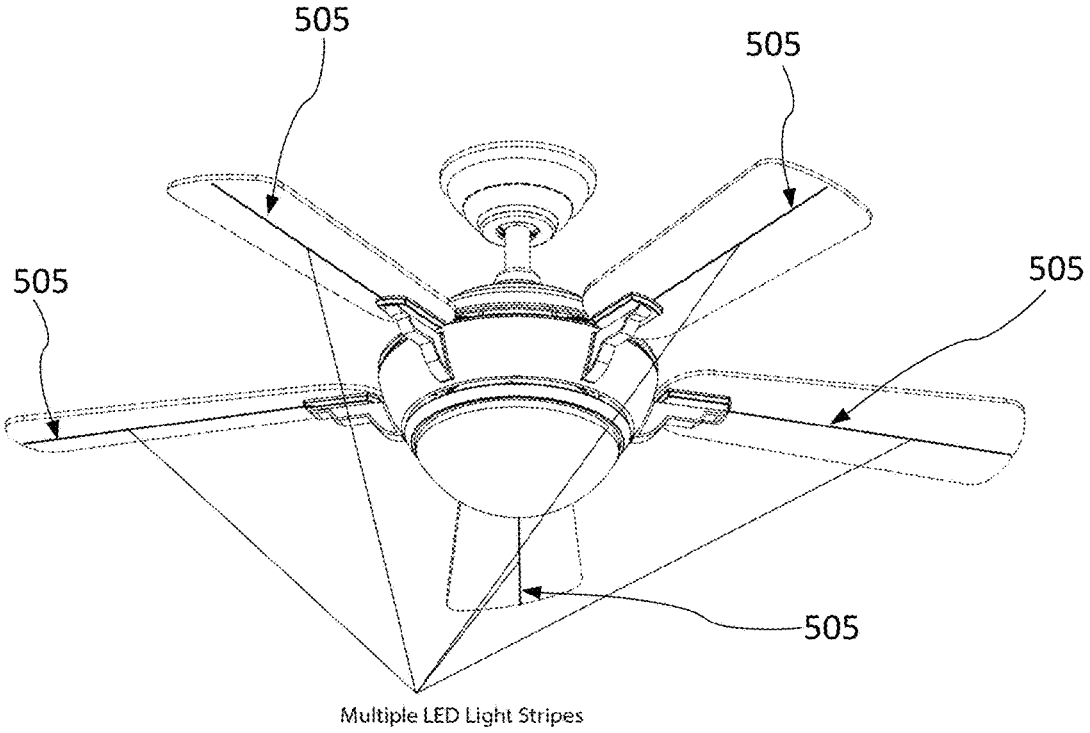
FIG. 7 is an in-use view of a five-arm rotary display consistent with certain embodiments of the present invention on a ceiling fan.

In some embodiments, a first linear display arm and a second linear display arm may be mounted such that the LED pitch is maintained between LEDs on the two linear display arms. Specifically, the distance between a first LED on the first linear display arm and a first LED on the second linear display arm may maintain the LED pitch. Note that the plurality of LEDs are not required to maintain the LED pitch at the center of the rotor. In fact there may be distinctive gaps between the center of the rotor and the two or more linear display arms as shown in FIG. 7. If there are no LEDs at the center of the rotor, then the 2-dimensional image will form around the center of the rotor and may not include the center of the rotor.

The two or more linear display arms project away from the center of the rotor at equally spaced angles around the rotor. Specifically, for the invention with N of the individual linear display arms (where N≥2), a separation angle formed by the individual linear display arms that are adjacent to each other is 360/N degrees. For an embodiment of the invention with 2 of the individual linear display arms, the separation angle formed by the individual linear display arms is 180 degrees and the individual linear display arms extend from the center of the rotor in opposite directions. For an embodiment of the invention with 3 of the individual linear display arms, the separation angle formed by the individual linear display arms is 120 degrees. For an embodiment of the invention with 4 of the individual linear display arms, the separation angle formed by the individual linear display arms is 90 degrees.

On each of the individual linear display arms, a line formed by the centers of the plurality of LEDs may be displaced from a radial extending from the center of rotation. The displacement may be perpendicular to the radial extending from the center of rotation. The displacement may be known as the linear display offset and the linear display offset may be different for each of the individual linear display arms. The linear display offset is calculated based upon a gap distance, which is the distance between the first LED and the second LED, which are adjacent to each other, as measured between their closest edges. Specifically, for the $n^{th}$ one of the individual linear display arms, where $1 \leq n \leq N$, the linear display offset is calculated to be:

$$\mathrm{OFFSET}_n = G \times ((n-1)/N)$$

where G is the gap distance and

N is the count of the individual linear display arms

In a non-limiting example, using this formula in the case where the gap distance is 0.9 mm, we find that:

- For an embodiment of the invention with 2 of the individual linear display arms (N=2) disposed about the central shaft, the first arm (n=1) should have the linear display offset set to 0.0 mm and the second arm (n=2) should have the linear display offset set to 0.5×0.9 mm, or 0.45 mm.
- For an embodiment of the invention with 3 of the individual linear display arms (N=3) disposed about the central shaft, the linear display offsets of the individual linear display arms should be 0.0 mm, 0.3 mm, and 0.6 mm.
- For an embodiment of the invention with 4 of the individual linear display arms (N=4) disposed about the central shaft, the linear display offsets of the individual linear display arms should be 0.0 mm, 0.225 mm, 0.45 mm, and 0.675 mm.

The linear display offsets are an important feature of the invention because the offsets improve the appearance and persistence of the display. Specifically, when the first linear display arm is aligned at the specific display angle it displays a specific portion of the 2-D image corresponding to the specific display angle. When the second linear display arm rotates to the specific display angle it also displays the specific portion of the 2-D image corresponding to the specific display angle. However, because of the linear display offset, the second linear display arm does not occupy exactly the same position. The inventors assert that this offset, and the resulting persistence, provides increased resolution, reduced gaps in the imaging, increased brightness, and reduced graininess.

In some embodiments, the two or more linear display arms may be fabricated as a single component having multiple sets of the plurality of LEDs so that a single component may be attached to the rotor. As a non-limiting example, a Y-shaped rotor may comprise three of the individual linear display arms.

The present invention provides a proprietary calculating mechanism to display high quality images or videos with high clarity and resolution through calculating the rotating speed, LED light pixel pitch and positioning in the rotation status.

Turning now to FIG. 1, this figure presents a perspective view of the invention 100. In the embodiment illustrated, the two or more linear display arms 500, the rotor 400 and the stator 200 are identified and the positioning of the plurality of LEDs 550 is shown. In a preferred embodiment, the system will have four or more linear display arms 500 for the creation of higher resolution images.

Figure 2:
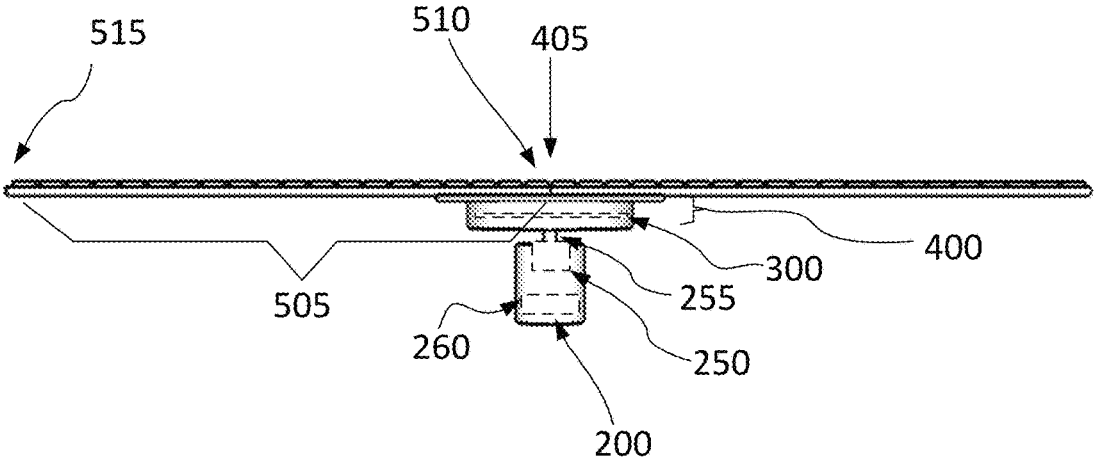
FIG. 2 is a side view of a two-arm rotary display consistent with certain embodiments of the present invention.

Turning now to FIG. 2, this figure presents a side view of the embodiment shown in FIG. 1. The position of the electric motor 250 in the stator 200 is marked. The position of the one or more batteries 260 in a hand-held version of the invention 100 is also marked. The proximal end 510 of the first linear display arm 650 is positioned at the center of the rotor 405 and the distal end 515 is positioned at the opposite end of the individual linear display arm 505, away from the center of the rotor 405. FIG. 2 shows the shaft 255 of the electric motor 250 coupling the stator 200 to the rotor 400. FIG. 2 also shows a possible location of the control electronics 300 within the rotor 400.

Figure 3:
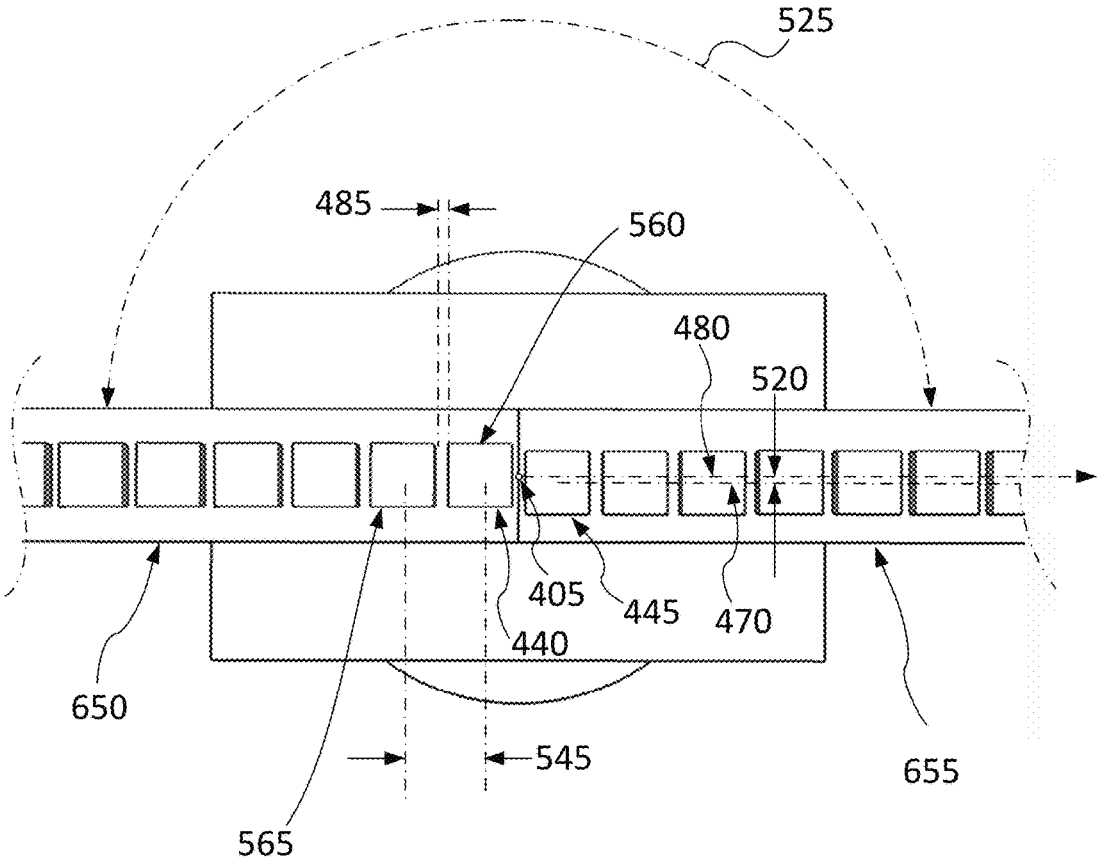
FIG. 3 is an overhead view of a two-arm rotary display consistent with certain embodiments of the present invention.

Turning now to FIG. 3, this figure presents an overhead view of the embodiment of FIG. 1. The second linear display arm 655 is aligned with the first linear display arm 650. The plurality of LEDs 550 on the second linear display arm 655 are displaced from the radial extending from the center of rotation 480 by the linear display offset 520. FIG. 3 illustrates the separation angle 525 between the two or more linear display arms 500, in this case 180 degrees. FIG. 3 also illustrates the LED pitch 545 and the gap distance 485. In FIG. 3, the first LED on the first linear display arm 440 and the first LED on the second linear display arm 445 are positioned such that the space between them maintains the gap distance 485.

Figure 4:
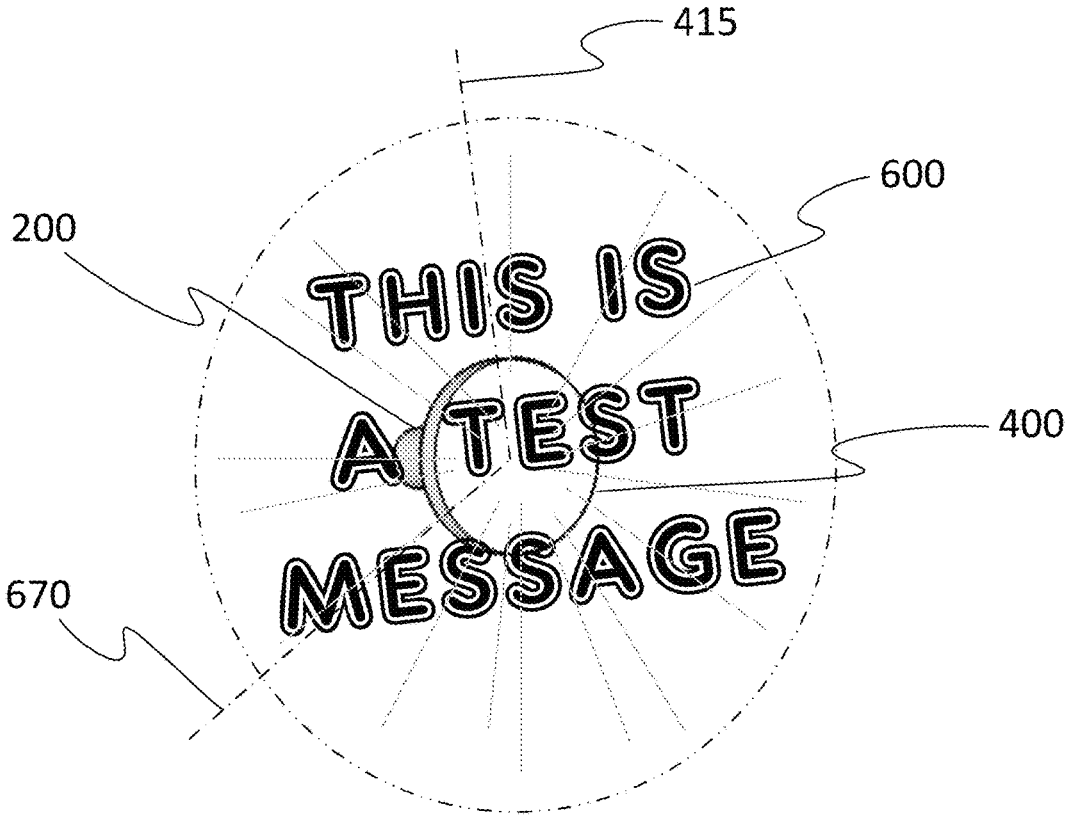
FIG. 4 is an in-use view of a two-arm rotary display consistent with certain embodiments of the present invention.

Turning now to FIG. 4, this figure presents a representation of the invention 100 while in use. In this case the stator 200 is being held or has been mounted in a horizontal position so that the rotor 400 spins in a vertically oriented plane. As the plurality of LEDs 550 follow the circular paths at various distances from the center of the rotor 405 they are timely energized by the control electronics 300 to present the 2-dimensional image 600—in this case a text message stating "THIS IS A TEST MESSAGE". As the rotor 400 spins, the second linear display arm 655 will eventually occupy the specific display angle 670 that was occupied by the first linear display arm 650 moments earlier, however the plurality of LEDs 550 on the second linear display arm 655 will be offset by the linear display offset 520. At the same time, the first linear display arm 650 will occupy the angular position previously occupied by the second linear display arm 655 and it will also be offset from that position by the linear display offset 520. Energization of the plurality of LEDs 550 on both the first linear display arm 650 and the second linear display arm 655 at that time will show the specific portion of the 2-D image that is appropriate for the specific display angle 670. The specific portion of the 2-D image will be slightly offset from the previous image and this offset enhances appearance of the display. FIG. 4 also marks the reference angle 415 which the control electronics 300 is using as a reference for synchronization and orientation of the 2-dimensional image 600.

Figure 5:
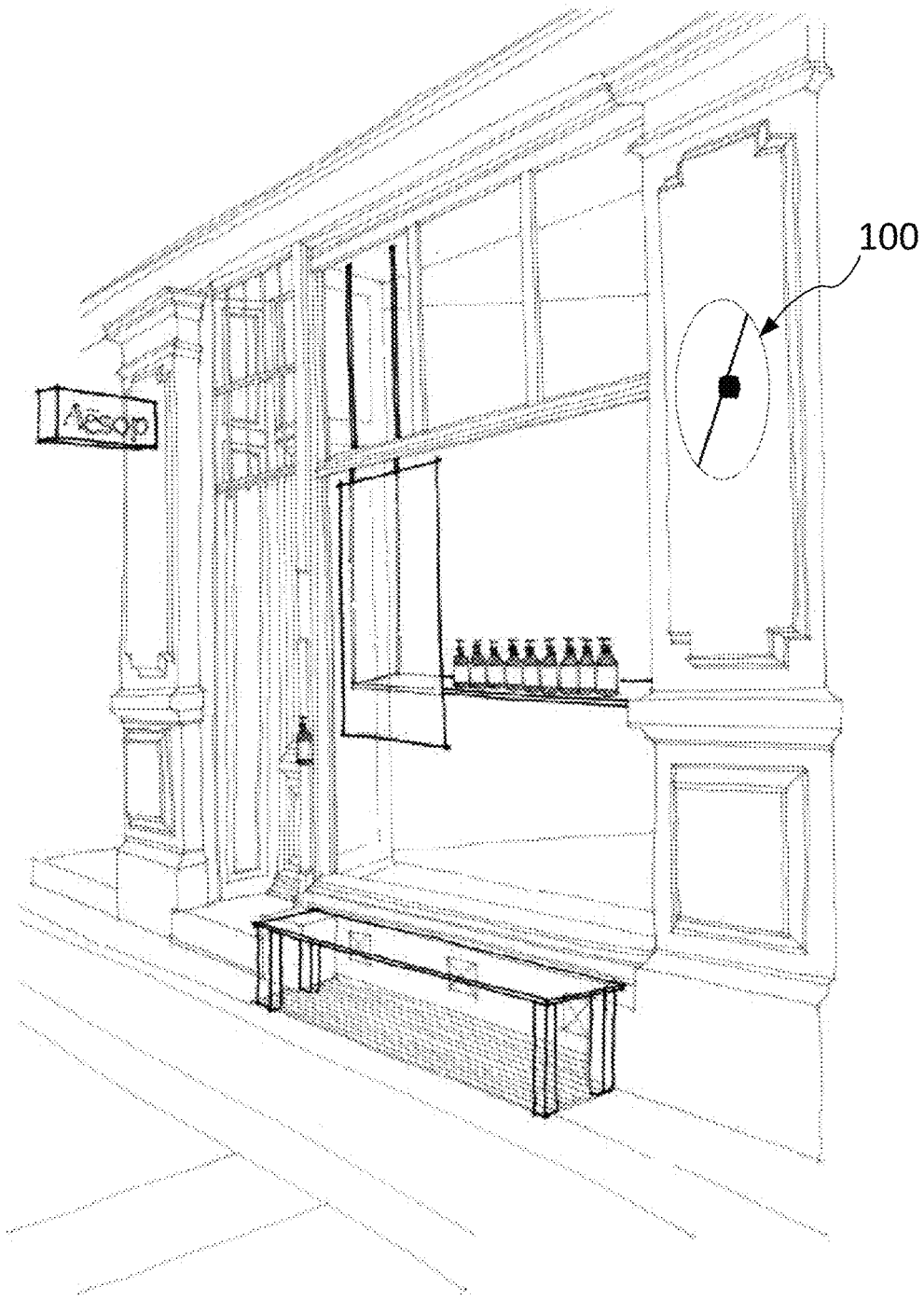
FIG. 5 is an in-use view of a two-arm rotary display consistent with certain embodiments of the present invention in a retail environment.

Turning now to FIG. 5, this figure illustrates use of the invention 100 as a sign within a store. The invention 100 has been mounted on a wall with the 2-dimensional image 600 vertically oriented. The 2-dimensional image 600 may present a logo, show pricing information, call attention to a sale price, present a clock, or display other text and/or graphics useful in a retail environment. The 2-dimensional image 600 may cycle through several different views, such as the clock followed by the logo followed by the pricing information. One or more of the 2-dimensional images 600 presented on the invention 100 may be animation or full motion video.

Figure 6:
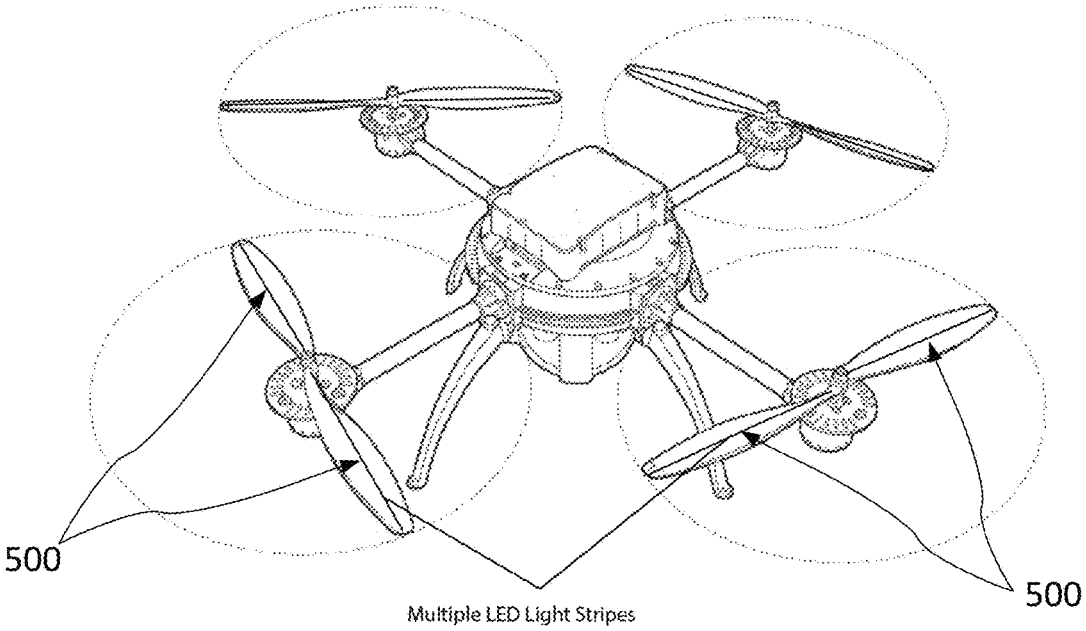
FIG. 6 is an in-use view of multiple two-arm rotary displays consistent with certain embodiments of the present invention on a drone.

Turning now to FIG. 6, this figure shows a drone that comprises the invention 100. Specifically, each propeller of the drone provides the two or more linear display arms 500. The two or more linear display arms 500 may reside on the top of each propeller, the bottom of each propeller, both sides of each propeller, or a combination thereof. The two or more linear display arms 500 on each propeller may work independently of each other, with each propeller displaying an image and controlling timing of image changes independent of the image and timing use on other propeller or two or more propellers may coordinate the image selection and timing. In some embodiments where the propellers are either at different heights or are synchronized so that there is no risk of propeller blades striking each other, the circular fields swept by each propeller may overlap and this may allow displayed images to touch when see from a direction perpendicular to the plane of the propeller rotation.

Turning now to FIG. 7, this figure illustrates the use of the invention 100 on a ceiling fan. In this case, the individual linear display arms 505 are applied to the bottom side of the blade of an overhead fan. As the fan turns, the blades may present textual message, graphics, or a combination thereof to viewers sitting in the room below the fan. FIG. 7 corresponds to an n=5 configuration of the invention 100 with the separation angle 525 set to 72 degrees. In this case the electric motor 250 is the same motor that turns the fan and the control electronics 300 may be embedded in the central hub of the fan, above the central light.

Figure 8:
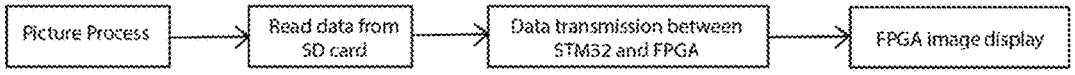
FIG. 8 is an illustration of the path of image data consistent with certain embodiments of the present invention.

Turning now to FIG. 8, this figure summarizes the data path of an image that is displayed on the present invention. Picture Process 800:

Read the required picture or image data through the operation of a numerical computing environment. As a non-limiting example, the numerical computing environment may be Matlab. The picture reading module is used to read the desired picture through Matlab's Imread function and pass the read information to the Circle Generation Module (CGM) and the Coordinate Corresponding Module (CCM). The Circle Generation Module (CGM) is adapted to make a maximum size of circle in the desired picture according to the information read by the Picture Read Module (PGM) and find the coordinates of the circle center and pass the circular information to the Coordinate Corresponding Module (CCM). The Coordinate Corresponding Module (CCM) is used to divide the circle into fixed N copies according to the information of the circle obtained by communicating with the Circle Generation Module (CGM). Each of the fixed N copies is divided into M lamps and the M coordinates are sequentially obtained by the center coordinates x N coordinate point coordinate information. This information is combined with the RGB value read by the Picture Read Module (PGM) to determine the M×N coordinates corresponding to the RGB data point information. The RGB data point information is then transmitted and stored into the SD card.

In an embodiment, the SD card is used for storing RGB data point information and communicates with the driver chip CH376 of the SD card through the SPI of the STM32 controller. The STM32 controller is used for communication between the SPI and the driver chip CH376 of the SD card and communicates with the SD card data write module in the FPGA unit through the communication protocol which is transmitted in parallel with the custom data.

The SD card data write module is used for communicating with the STM32 controller and transmitting the obtained information to the SDRAM data read/write module.

The SDRAM data read/write module is used to store the SD card data write module from the STM32 controller into the FIFO, write it into the SDRAM, and send the information filled with a picture to the LED display control module for detecting a trigger picture display signal and transmitting the picture display signal to the LED display control module.

The LED display control module is used to sequentially write the data of the first line in the picture information sent by the SDRAM data read/write module according to the picture display signal to display the corresponding color and display the next color at the same time interval, while controlling the motor rotation. The whole picture will be fully displayed upon completion of one full circle of the rotation of the display arms.

In an embodiment, the LED display control module may then create a circle with the maximum size according to information in this picture, and subsequently locate the center point of this circle. In an embodiment, the system utilizes the following method of creating a circle with the maximum size: Calculate the length and width of the picture through a function designated as the SIZE function, according to collected information read by the Imread function. Use the smaller value of half of length vs. half of width as the radius of the circuit. Use the intersection point of rectangular diagonal lines as the center of the circle.

Read Data from SD Card 802:

The circle obtained in Step 1 is divided into fixed number of N parts, and each of them is divided into M lamps. The coordinates of the center points found have the corresponding coordinates of the M×N coordinate points RGB data points. These fixed coordinate points form the RGB data points through the Fprint function into the SD card.

Data Transmission 804:

Establish a communication channel for the data transfer to the driver chip CH376 inside the SD card by using the STM32's SPI. This STM32 uses a custom data parallel transmission protocol to communicate with the FPGA. Specifically, ten signal circuits establish the hardware connection for data communication in eight data bits to transfer signals of Write Request and Write Full. When the signal value of Write Full is NULL, the system will read data from the SD card and convert to required eight-data-bits data format and ready for the data transmission. The system may then trigger the FPGA Write signal by lowering down the Write Request signal level. FPGA will read data simultaneously. The Write Full signal will level up when the buffer within the FPGA is getting full. The Write Full signal will level down when all the relevant data is read out of the buffer, then stop the writing process.

The FPGA unit is composed of SDRAM, SDRAM data read/write module, SD card data write module, and LED display control module.

Image Display 806:

Write the data read from the STM32 through the FPGA system to FIFO. Then write to the SDRAM when the FIFO queue is full. Then start the LED display control function when the whole date of a picture or a video is fully loaded to the SDRAM. An external photoelectric tube will trigger to display the picture upon detecting the signal of the display control. The data of the first line of the picture will be written to the LED, displaying the corresponding color, meanwhile displaying the data of the next line of the picture and so on, while controlling the motor rotation. The whole picture will be fully displayed after a full circle of the rotation is completed.

Figure 9:
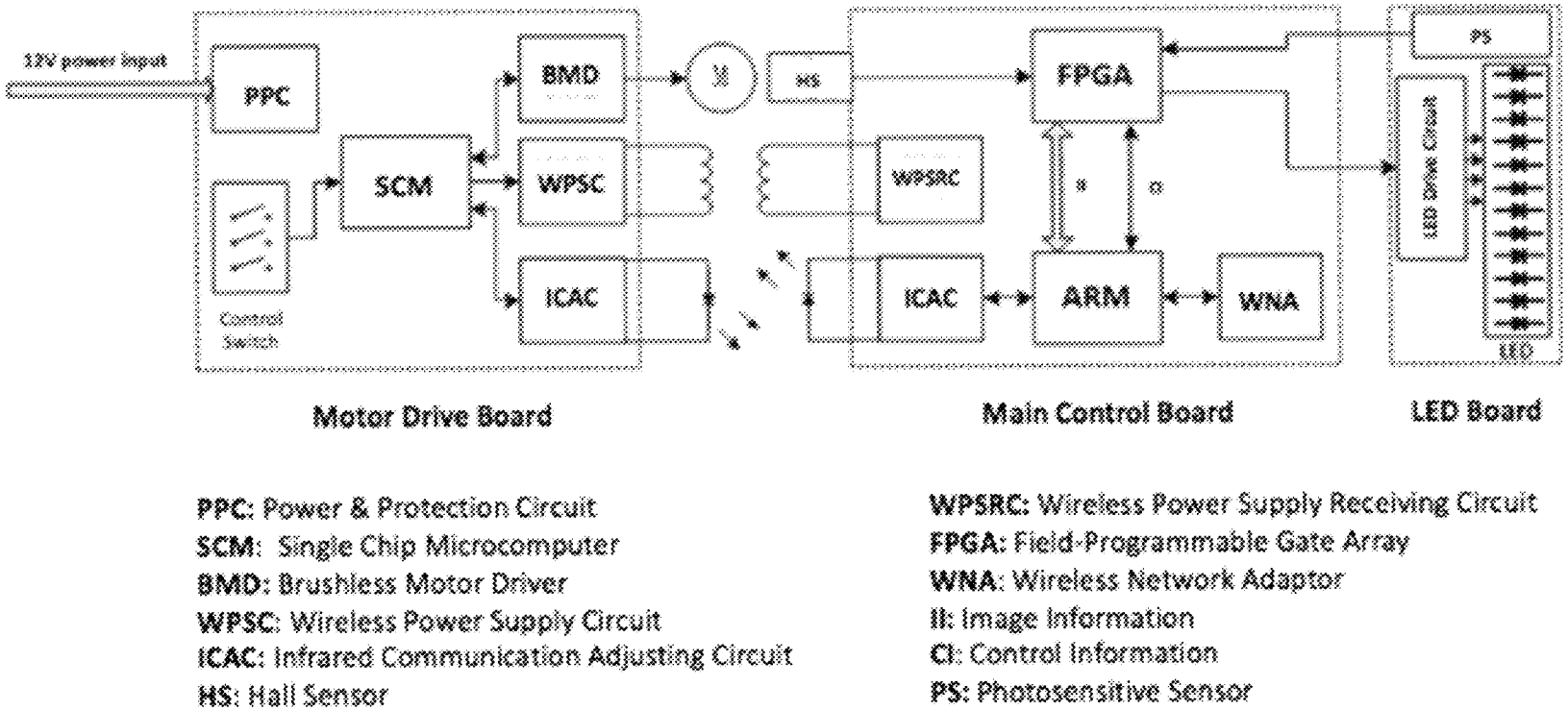
FIG. 9 is a block diagram of hardware components consistent with certain embodiments of the present invention.

Turning now to FIG. 9, this figure illustrates some interrelationships between hardware blocks consistent with certain embodiments of the present invention. Illustrated are a Motor Drive Board, a Main Control Board, and an LED Board.

The Motor Drive Board may comprise a Power and Protection Circuit, a Brushless Motor Driver, a Wireless Power Supply Circuit, an Infrared Communication Adjusting Circuit, and a Single Chip Microcomputer.

The Main Control Board may comprise a Wireless Power Supply receiving Circuit, an Infrared Communication Adjusting Circuit, a Wireless Network Adapter, a Field Programmable Gate Array, and an ARM processor.

The LED Board may comprise a plurality of LEDs, an LED Drive Circuit, and a Photosensor.

The Main Control Board may sense the rotational speed of the motor using a Hall Sensor. The Main Control Board and the Motor Drive Board may communicate with each other using the Infrared Communication Adjusting Circuit. Using the Wireless Power Supply Receiving Circuit, the Main Control Board may receive power sent from the Motor Control Board via the Wireless Power Supply Circuit. The Main Control Board may sense the ambient light level using the PhotoSensor on the LED Board.

Figure 10:
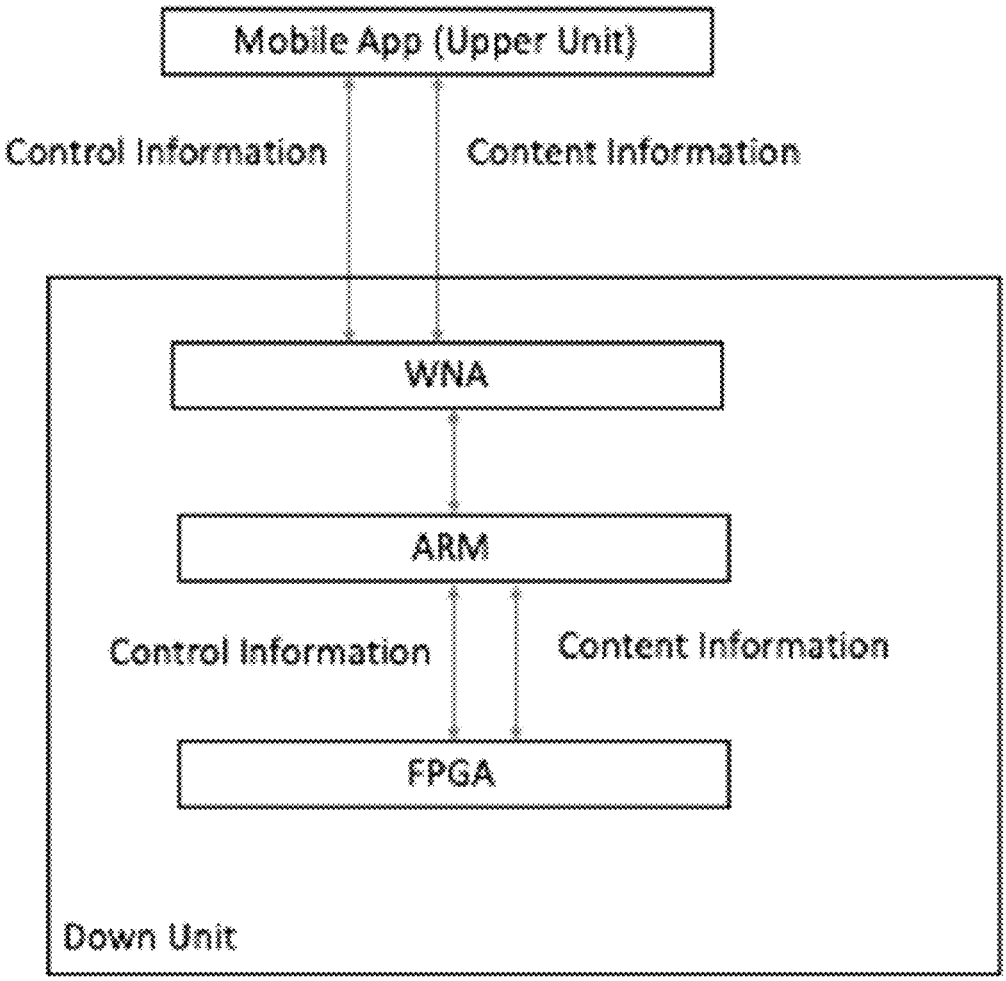
FIG. 10 is an illustration of information paths consistent with certain embodiments of the present invention.

Turning now to FIG. 10, this figure is an illustration of information paths consistent with certain embodiments of the present invention. The Mobile app is defined as an Upper POV (Point of View) unit. The display system is defined as a Down POV unit. The communication between the upper and down units is bidirectional

- The Upper unit can send data which the Down unit receives.
- The Down unit can also send data which the Upper unit receives.
- The Upper and Down units transmit and receive.
- The mobile app is designed to 1. Operate the display system
   - Upper unit sends various of control signals (e.g. On/off or Brightness level) to the Down unit using 2.4 GHz WiFi protocol.
   - The WNA (Wireless Network Adaptor) of the Down unit is in charge of sending and receiving the control information to/from the Upper Unit.
   - The ARM (Advanced RISC Machines) of the Down unit commands WNA for the upward and downward communication of the control information with the Upper unit.
2. And Provide for Content Management
   - Delete content from the App—the Upper unit sends DELETE signal to ARM via WNA. ARM then updates the local content play list.
   - Content information includes 1) File information and 2) File content
   - The File content will be sent in segments, each of which is 1K byte size.
   - When sending the content from the Upper unit, it always sends the File Information first, then the File Content.
   - When receiving the content, the Down unit determines when to stop receiving, based upon the File Information that tells the size of the file.
   - New content sent from the App to the Display system—the Upper Unit sends content information (images or videos) via Wifi. WNA receives and passes to ARM.

ARM stores the data and updates the local content play list, and then commands FPGA (Field-programmable Gate Array).

While certain illustrative embodiments have been described, it is evident that many alternatives, modifications, permutations and variations will become apparent to those skilled in the art in light of the foregoing description.

We claim:

1. A rotary display device, comprising:

a rotor, stator, and two or more linear display arms, where said rotor and stator are installed within a central hub and said two or more linear display arms are connected to said central hub at a proximal end;

a microprocessor control board installed within said central hub;

said central hub forming one portion of a rotating shaft of said rotor;

each of said two or more linear display arms having a row of LED elements attached along the middle portion of each of the two or more linear display arms and extending the length of each of the two or more linear display arms;

an LED position offset applied to one row of LED elements on a first linear display arm with respect to a row of LED elements on a second or additional linear display arm where said LED position offset provides for extended image persistence;

said microprocessor control board in wireless communication with an external processor;

the rotating shaft rotating under control of said microprocessor to spin said two or more linear display arms in a circle around said central hub, and where said microprocessor activates said rows of LED elements to form a persistent visual image during activation of said LED elements during the rotation of said rotating shaft where the LED position offset displaces a line formed by the centers of the one row of LED elements in a direction that is perpendicular to a radial extending from the center of rotation;

where the LED position offset is different for each of the two or more linear display arms.

2. The device of claim 1, further comprising the microprocessor receiving LED control files from an exterior processor, where said LED control files provide instructions for creating particular persistent visual image displays.

3. The device of claim 1, where the microprocessor further comprises a Field Programmable Gate Array (FPGA).

4. The device of claim 1, where the two or more linear display arms may be attached to said central hub in associated pairs.

5. The device of claim 1, where the two or more linear display arms may be attached to said central hub in positions calculated to form a pre-calculated geometry.

6. The device of claim 1, further comprising a Motor Drive Board further comprised of a Power and Protection Circuit, a Brushless Motor Driver, a Wireless Power Supply Circuit, an Infrared Communication Adjusting Circuit, and a Single Chip Microcomputer.

7. The device of claim 1, where said LED position offset of the row of LED elements on the first linear display arm and the row of LED elements on the second or additional linear display arm are positioned such that the space between them maintains a gap distance calculated to create greater visual persistence when in operation.

8. The device of claim 1, further comprising a mobile application on a mobile or network connected device to permit a user to control the operation of said rotary display device from said mobile application.

* * * * *